US012698062B2

(12) United States Patent
Wang et al.

(10) Patent No.: US 12,698,062 B2
(45) Date of Patent: Aug. 4, 2026

(54) FLOW-GUIDE DEVICE FOR OFFSHORE PLATFORM

(71) Applicant: Hohai University, Nanjing (CN)

(72) Inventors: Hao Wang, Nanjing (CN); Jiaojie Xie, Nanjing (CN); Xin Cai, Nanjing (CN); Bofeng Xu, Nanjing (CN); Lei Ren, Nanjing (CN); Maowen Cai, Nanjing (CN); Zhitong Lv, Nanjing (CN); Lei Wang, Nanjing (CN); Yazhou Wang, Nanjing (CN); Xingwen Guo, Nanjing (CN)

(73) Assignee: HOHAI UNIVERSITY (CN)

( * ) Notice: Subject to any disclaimer, the term of this patent is extended or adjusted under 35 U.S.C. 154(b) by 224 days.

(21) Appl. No.: 18/787,019

(22) Filed: Jul. 29, 2024

(65) Prior Publication Data

US 2025/0313309 A1 Oct. 9, 2025

(30) Foreign Application Priority Data

Apr. 9, 2024 (CN) ..... 202410421791.9

(51) Int. Cl.
*B63B 35/44* (2006.01)
*B63B 22/20* (2006.01)
(Continued)

(52) U.S. Cl.
CPC ..... *B63B 35/44* (2013.01); *B63B 22/20* (2013.01); *B63B 39/03* (2013.01); *B63B 39/06* (2013.01); *B63B 2207/02* (2013.01)

(58) Field of Classification Search
CPC ..... B63B 35/44; B63B 22/20; B63B 39/03; B63B 39/06; B63B 2207/02
See application file for complete search history.

(56) References Cited

U.S. PATENT DOCUMENTS 6,857,266 B2 * 2/2005 Dick ..... F03B 13/20 60/497
6,953,308 B1 * 10/2005 Horton ..... B63B 35/44 405/195.1
(Continued)

FOREIGN PATENT DOCUMENTS

CN 115258071 A * 11/2022 ..... B63B 35/44
CN 115405457 A * 11/2022 ..... F03D 9/25
(Continued)

*Primary Examiner* — Brian Christopher Delrue

(57) ABSTRACT

Disclosed is a flow-guide device for an offshore platform, comprising a flow-guide column base, a ballast level control device and a spiral side belt system, wherein the flow-guide column base is located at the bottom of an offshore platform, and multiple flow-guide column bases are arranged symmetrically and distributed in a ring array; the flow-guide column base is rotatably connected to the offshore platform; a ballast compartment is arranged in the flow-guide column base, and the ballast level control device is used for controlling a ballast level in the ballast compartment; and the spiral side belt system is arranged outside the flow-guide column base and used for restraining vortex-induced resonance. The flow-guide column base and the offshore platform can be kept in a relatively fixed state by means of a clamping device, such that the offshore platform is able to rotate synchronously with the flow-guide column base.

10 Claims, 7 Drawing Sheets

(51) Int. Cl.
*B63B 39/03* (2006.01)
*B63B 39/06* (2006.01)

(56) References Cited

U.S. PATENT DOCUMENTS

| | | | | |
|---|---|---|---|---|
| 8,770,894 | B1 * | 7/2014 | Allen | E21B 17/01 405/211.1 |
| 9,511,825 | B1 * | 12/2016 | Henning | B63B 39/06 |
| 2011/0044764 | A1 * | 2/2011 | Leverette | B63B 39/06 405/216 |
| 2025/0313309 | A1 * | 10/2025 | Wang | B63B 35/44 |

FOREIGN PATENT DOCUMENTS

| | | | | | |
|---|---|---|---|---|---|
| CN | 116923654 | A | * | 10/2023 | B63B 35/44 |
| CN | 118004346 | A | * | 5/2024 | B65H 75/38 |
| CN | 118083061 | A | * | 5/2024 | B63B 43/10 |
| CN | 118270186 | A | * | 7/2024 | B63B 39/005 |
| CN | 118494683 | A | * | 8/2024 | B63B 39/06 |
| CN | 118722958 | A | * | 10/2024 | B63B 35/44 |
| CN | 120773887 | A | * | 10/2025 | B63B 17/00 |
| CN | 121087949 | A | * | 12/2025 | |
| WO | WO-2018095304 | A1 | * | 5/2018 | F03D 13/25 |

* cited by examiner

FLOW-GUIDE DEVICE FOR OFFSHORE PLATFORM

CROSS-REFERENCE TO RELATED APPLICATIONS

This application claims priority to Chinese Application No. CN202410421791.9, having a filing date of Apr. 9, 2024, the entire contents of which are hereby incorporated by reference.

TECHNICAL FIELD

The invention relates to the field of marine engineering, and particularly relates to a flow-guide device for an offshore platform.

BACKGROUND OF THE INVENTION

Human's development and utilization of marine resources lead to an increasingly wider application of offshore platforms such as offshore observation platforms, offshore oil platforms and offshore wind platforms. The offshore platforms, as indispensable equipment for marine resource exploration and development, are an important development direction in the field of marine engineering.

According to their structure, there are mainly two types of offshore platforms: fixed offshore platforms and floating offshore platforms, wherein the fixed offshore platforms are suitable for shallow sea areas, and the floating offshore platforms are suitable for deep sea areas. Compared with the fixed offshore platforms, the floating offshore platforms have the advantages of being controllable in cost and easy to transport, but they also face more complex technical challenges. Because the lower portion of the floating platform can move freely within a certain range, it is not only under the action of multi-fled loads including winds, waves and sea currents, but also under the influence of the motion response of the platform, the action of a mooring system, radiation damping and other factors. All these factors will exert an influence on the dynamic stability of a floating wind platform. Especially, the dynamic stability of floating platforms under the coupled dynamic action of external loads and structures is one of the focuses in the existing research field. In addition, the floating offshore platforms also need to take into account the inconsistency of an incoming wind flow and an incoming water flow, which may lead to a change of the hydrodynamic performance of the platforms, thus compromising the wave resistance and wind resistance of the platforms.

The improvement in the hydrodynamic performance of the floating offshore platforms needs to take into account the overall influence of the windshear, waves, sea currents and other external factors on the structural system. The change in the angle of incidence of waves has a great influence on motions of different floating offshore platforms, the platforms have the optimal hydrodynamic performance in a case where the angle of incidence of waves is 0°, and the response amplitude operator may increase by nearly a hundred times with the increase in the angle of incidence of waves. Therefore, the floating offshore platforms should ensure that waves flow in forward to avoid an excessively large lateral force. It is urgently needed to develop a novel adaptive load reduction technique for floating offshore platforms in the field of floating marine engineering.

SUMMARY OF THE INVENTION

In view of the defects in the prior art, the objective of the invention is to provide a flow-guide device for an offshore platform. The flow-guide device can rotate according to the direction of waves to allow the waves to flow in forward, can also lower the center of gravity of a platform, and restrain vortex-induced vibrations that possibly happen to a deep-draft platform, thus improving the stability of a floating offshore platform under the complex action of winds, waves and sea currents.

To fulfill the above purpose, the invention adopts the following technical solution:

A flow-guide device for an offshore platform comprises a flow-guide column base, a ballast level control device and a spiral side belt system, wherein the flow-guide column base is located at a bottom of an offshore platform, and multiple flow-guide column bases are arranged symmetrically and distributed in a ring array; a cross-section of the flow-guide column base is in a streamlined shape, and the flow-guide column base is rotatably connected to the offshore platform; a ballast compartment is arranged in the flow-guide column base, and the ballast level control device is used for controlling a ballast level in the ballast compartment; and the spiral side belt system is arranged outside the flow-guide column base and used for restraining vortex-induced resonance.

Further, the flow-guide column base is connected to the offshore platform by means of a rotating device, the rotating device comprises a stepped rotating platform arranged at a top of the flow-guide column base, a groove matched with the stepped rotating platform is formed in the bottom of the offshore platform, and the stepped rotating platform is inlaid in the groove, such that the flow-guide column base is rotatable with respect to the offshore platform.

Further, a shape of the cross-section of the flow-guide column base satisfies:

$$C_{wp} = \frac{A_w}{LB}$$

$$0.45 < C_{wp} < 0.65$$

where, $C_{wp}$ is a wetted area coefficient, $A_w$ is an area of the cross-section of the flow-guide column base, L is a length of a long axis of the cross-section of the flow-guide column base, and B is a length of a short axis of the flow-guide column base.

Further, the flow-guide device for an offshore platform further comprises a clamping device, wherein the clamping device is used for keeping the flow-guide column base and the offshore platform in a relatively fixed state, such that the offshore platform is able to rotate synchronously with the flow-guide column base.

Further, the clamping device comprises clamping holes and clamping rods, each clamping hole comprises an upper clamping hole formed in the bottom of the offshore platform and a lower clamping hole formed in a top of the flow-guide column base and corresponding to the upper clamping hole, and the clamping holes are distributed in a ring array; and one clamping rod is arranged in each clamping hole, and the clamping rods completely retract to the bottom of the offshore platform or partially slide into the flow-guide column base by means of the clamping holes to keep the flow-guide column base and the offshore platform in the relatively fixed state.

Further, the ballast level control device comprises a vent valve duct, and the vent valve duct is located at a center of a top of the flow-guide column base and extends to the bottom of the offshore platform; and the vent valve duct is connected to the ballast compartment, and a vent valve cover is arranged at a joint of the ballast compartment and the vent valve duct and used for controlling the vent valve duct to be opened or closed.

Further, the ballast level control device further comprises a first sea valve hole, the first sea valve hole is located in a center of a bottom of the flow-guide column base and connected to the ballast compartment, the first sea valve hole is covered with a sea valve cover, and a hydraulic machine is arranged above the sea valve cover and connected to the sea valve cover by means of a valve rod.

Further, a hydraulic machine compartment is arranged in the ballast compartment, located above the sea valve cover and fixed to a bottom wall of the ballast compartment, the hydraulic machine is arranged in the hydraulic machine compartment, and a second sea valve hole is formed in a side wall between the hydraulic machine compartment and the sea valve cover.

Further, the spiral side belt system comprises multiple guide rails, two retainer rings and a retractable spiral side belt, the multiple guide rails are symmetrically arranged on an outer surface of the flow-guide column base, the two retainer rings are disposed around the outer surface of the flow-guide column base and are able to slide upward and downward along the guide rails, the spiral side belt spirally covers the outer surface of the flow-guide column base and is located between the two retainer rings, and two ends of the spiral side belt are connected to the two retainer rings respectively.

Further, stop pieces are arranged at upper and lower ends of each guide rail and used for limiting upper and lower positions to which the retainer rings move.

Compared with the prior art, the invention has the following beneficial effects:

According to the invention, by changing the flow pattern around the platform, the flow-guide column base can rotate separately or drive the offshore platform to rotate synchronously according to the direction of waves to ensure that the waves flow in forward, thus avoiding an excessive lateral wave force, improving the hydrodynamic performance of an offshore platform, and improving the wave resistance of a floating offshore platform; the ballast level can be controlled by the ballast level control device to selectively lower the center of gravity of the offshore platform to improve the stability of the offshore platform; when the flow-guide column base rotates, the spiral side belt of the retractable spiral side belt system can be retracted, such that the flow guide effect of the flow-guide column base will not be affected; and when the direction of waves does not need to be adjusted by the flow-guide column base, the spiral side belt can be unwound to restrain vortex-induced resonance that possibly happens to a deep-draft platform, thus improving the stability of the offshore platform.

In the FIG.: 1, flow-guide column base; 2, offshore platform (partial); 3, rotating device; 4, groove; 5, clamping hole; 6, clamping rod; 7, vent valve duct; 8, vent valve cover; 9, second sea valve hole; 10, hydraulic machine compartment; 11, hydraulic machine; 12, valve rod; 14, sea valve cover; 14, ballast compartment; 15, retainer ring; 16, spiral side belt; 17, guide rail; 18, stop piece; 19, first seat valve hole; 20, slider.

DETAILED DESCRIPTION OF THE INVENTION

The invention is further described below in conjunction with specific embodiments. The following embodiments are merely used for more clearly explaining the technical solution of the invention and are not intended to limit the protection scope of the invention.

As shown in FIGS. 1 and 3-5, one embodiment of the invention provides a flow-guide device for an offshore platform, comprising a flow-guide column base 1, a clamping device, a ballast level control device and a spiral side belt system.

Figure 6:
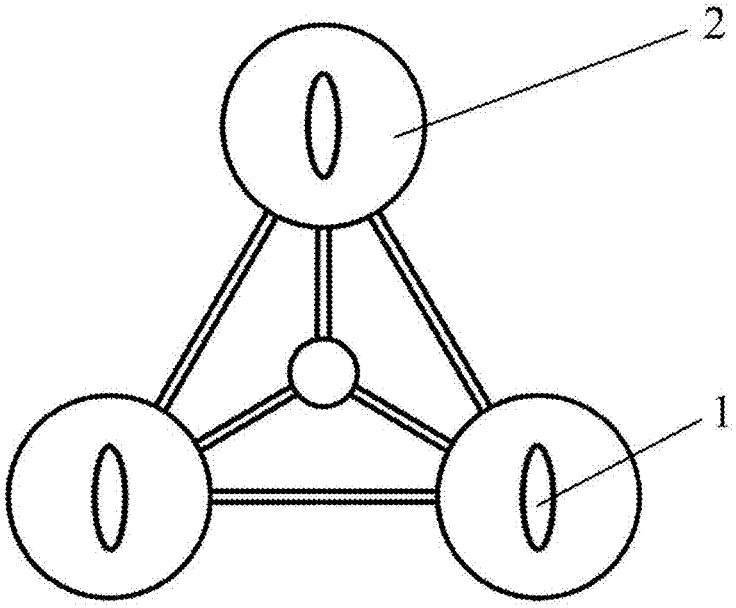
FIG. 6 is a diagram of an example of the arrangement of the flow-guide devices for an offshore platform at the bottom of a semi-submersible floating wind turbine platform according to one embodiment of the invention.

The flow-guide column base 1 is located at the bottom of an offshore platform 2, and multiple flow-guide column bases 1 are arranged symmetrically and distributed in a ring array. The offshore platform 2 may be an offshore observation platform, an offshore oil platform, an offshore wind platform, or the like. For example, in a case of three flow-guide column bases, the flow-guide column bases are arranged at the bottom of a semi-submersible wind turbine platform, as shown in FIG. 6. Of course, the invention is not limited to such an arrangement.

Figure 1:
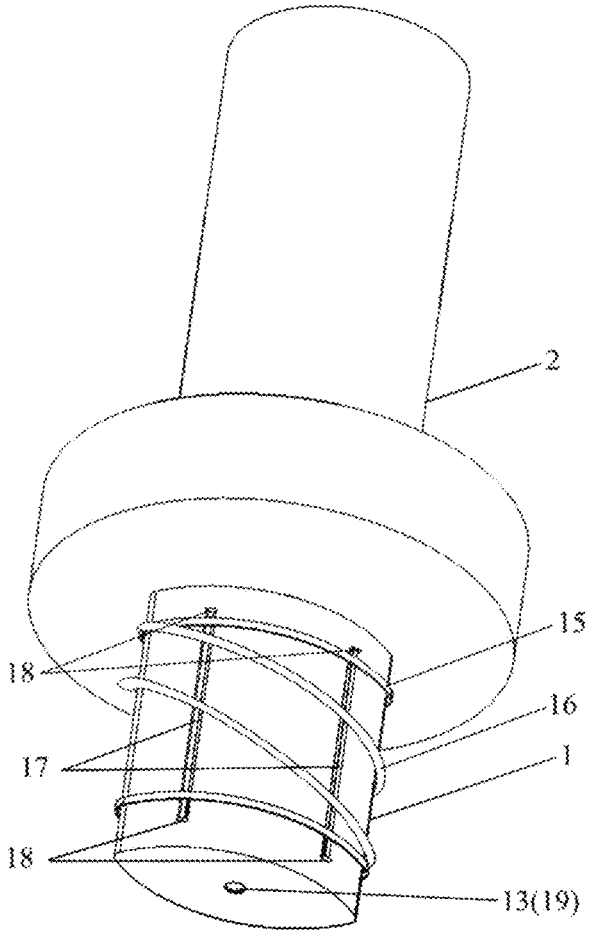
FIG. 1 is a schematic structural view of a flow-guide device for an offshore platform and one part of an offshore platform (a side column of a semi-submersible platform) according to one embodiment of the invention.
Figure 2:
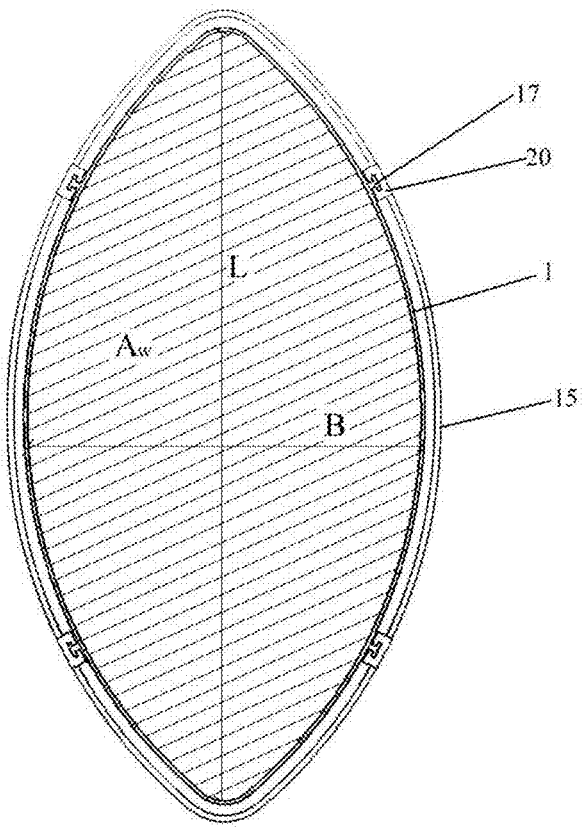
FIG. 2 is a schematic diagram of the shape and size of the cross-section of a flow-guide column base according to one embedment of the invention.

The cross-section of the flow-guide column base 1 may be wing-shaped, spindle-shaped, oval-shaped, or in the shape of a single-elliptic and double-parabolic streamline. As shown in FIG. 2, the shape of the cross-section of the flow-guide column base 1 satisfies:

$$C_{wp} = \frac{A_w}{LB}$$

$$0.45 < C_{wp} < 0.65$$

where, $C_{wp}$ is a wetted area coefficient, $A_w$ is an area of the cross-section of the flow-guide column base, L is the length of a long axis of the cross-section of the flow-guide column base, and B is the length of a short axis of the flow-guide column base.

Although FIG. 2 illustrates an embodiment where the cross-section of the flow-guide column base 1 is spindle-shaped, the above formula is not limited to the spindle-shaped cross-section of the flow-guide column base and is also applicable in a case where the cross-section of the flow-guide column base is wing-shaped, oval-shaped, or in the shape of the single-elliptic and double-parabolic streamline.

By adopting the above structure of the flow-guide column base 1, the flow-guide column base 1 can rotate according to the direction of waves under the action of a thrust from the waves, to adjust the inflow direction of the waves so as to maintain the angle of incidence of the waves at about 0°, that is, it is ensured that the waves flow in forward.

The flow-guide column base 1 is rotatably connected to the offshore platform 2, such that the flow-guide column base 1 is rotatable with respect to the offshore platform 2.

The clamping device is used for keeping the flow-guide column base 1 and the offshore platform 2 in a relatively fixed state, such that the offshore platform 2 is allowed to be driven by the flow-guide column base 1 to rotate synchronously to adjust the inflow direction of waves.

A ballast compartment 14 is arranged in the flow-guide column base 1, and the ballast level control device is used for controlling the water level in the ballast compartment 14 to selectively lower the center of gravity of the offshore platform 2 to improve the stability of the offshore platform 2.

The spiral side belt system is arranged outside the flow-guide column base 1 to restrain vortex-induced resonance.

Figure 3:
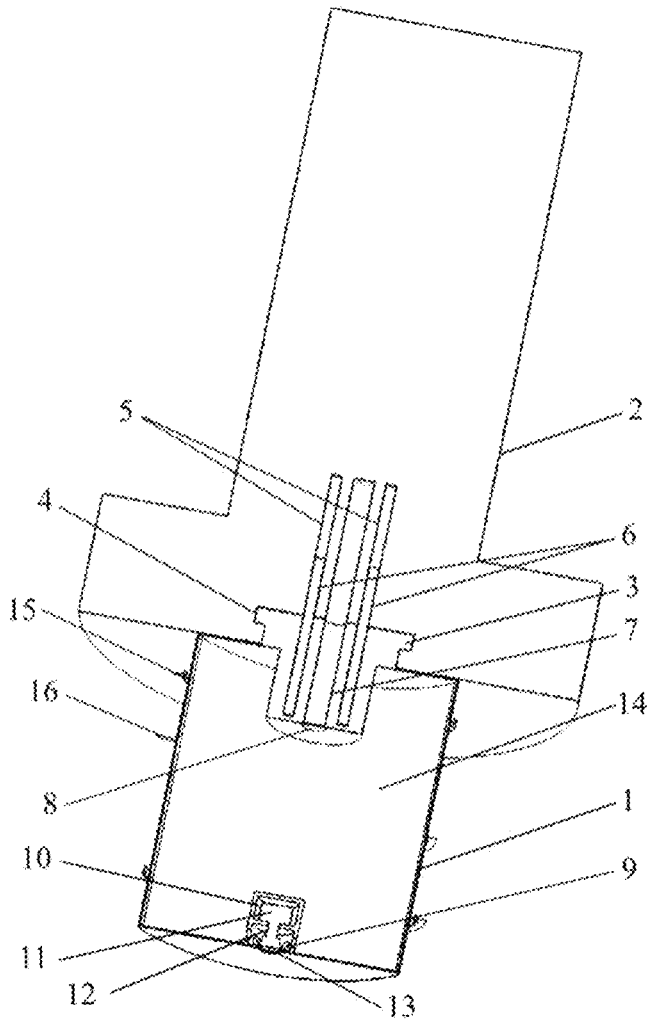
FIG. 3 is a cross-sectional structural view of the flow-guide device for an offshore platform and one part of the offshore platform (the side column of the semi-submersible platform) according to one embodiment of the invention.
Figure 4:
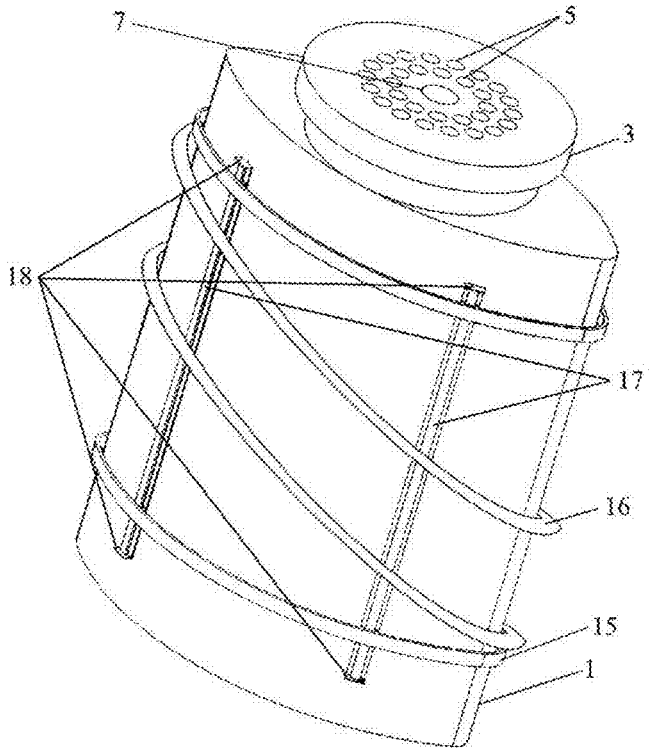
FIG. 4 is a schematic structural view of the flow-guide device for an offshore platform according to one embodiment of the invention.

As shown in FIGS. 3 and 4, the flow-guide column base 1 is connected to the offshore platform 2 by means of a rotating device 3. The rotating device 3 comprises a stepped rotating platform arranged at the top of the flow-guide column base 1, a groove 4 matched with the stepped rotating platform is formed in the bottom of the offshore platform 2, and the stepped rotating platform is inlaid in the groove 4, such that the flow-guide column base 1 is freely rotatable with respect to the offshore platform 2.

Under the action of a thrust from waves, the flow-guide column base 1 can adapt to the direction of sea currents to rotate freely according to the direction of the waves to ensure that the waves flow in forward, thus avoiding an excessive lateral wave force and improving the hydrodynamic performance of the offshore platform.

As shown in FIGS. 3 and 4, the clamping device comprises clamping holes 5 and clamping rods 6. Each of the clamping holes 5 comprises an upper clamping hole formed in the bottom of the offshore platform 2 and a lower clamping hole formed in the top of the flow-guide column base 1 and corresponding to the upper clamping hole.

Multiple clamping holes 5 are arranged and distributed in a ring array.

One clamping rod 6 is arranged in each clamping hole 6. The clamping rods 6 completely retract to the bottom of the offshore platform 2 or partially slide into the flow-guide column base 1 to keep the flow-guide column base 1 and the offshore platform 2 in the relatively fixed state.

A pull rope (not shown) is arranged at the top of each clamping rod 6. The pull ropes can be controlled to be taken up or paid off to control the clamping rods 6 to retract to the bottom of the offshore platform 2 or partially slide into the flow-guide column base 1.

When the clamping rods 6 completely retract to the bottom of the offshore platform 2, the flow-guide column base 1 can rotate separately according to the direction of waves. When the clamping rods 6 partially slide into the flow-guide column bases 1, the flow-guide column base 1 and the offshore platform 2 are kept in the relatively fixed state, and the flow-guide column base 1 drives the offshore platform 2 to rotate synchronously according to the direction of waves.

Figure 5:
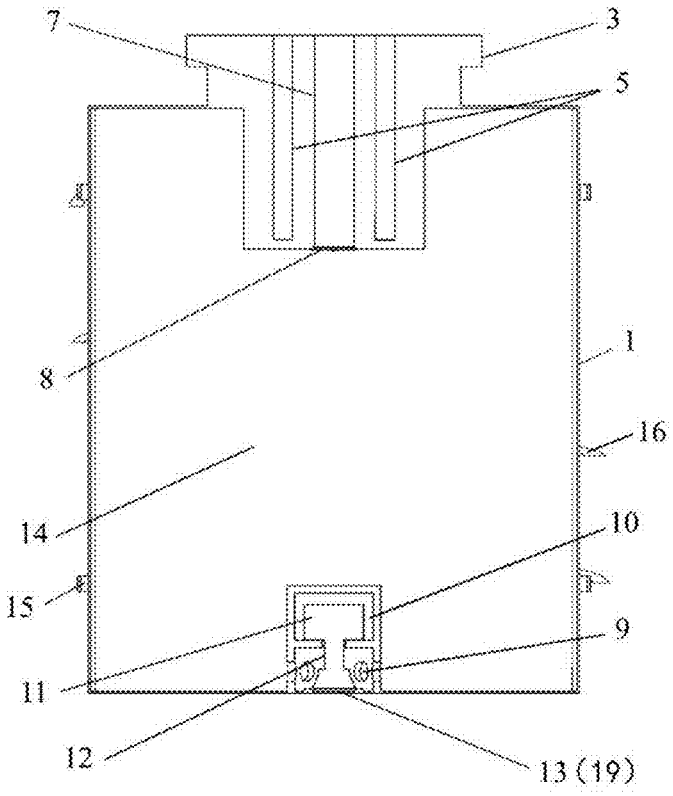
FIG. 5 is a cross-sectional structural view of the flow-guide device for an offshore platform according to one embodiment of the invention.

As shown in FIGS. 3 and 5, the ballast level control device comprises a vent valve duct 7, and the vent valve duct 7 is located at the center of the top of the flow-guide column base 1 and extends to the bottom of the offshore platform 2.

The vent valve duct 7 is connected to the ballast compartment 14, and a vent valve cover 8 is arranged at a joint of the ballast compartment 14 and the vent valve duct 7 and used for controlling the vent valve duct 7 to be opened or closed to adjust the pressure in the ballast compartment 14.

As shown in FIG. 5, the ballast level control device further comprises a first sea valve hole 19, and the first sea valve hole 19 is located in the center of the bottom of the flow-guide column base 1 and connected to the ballast compartment 14.

The first sea valve hole 19 is covered with a sea valve cover 13, and a hydraulic machine 11 is arranged above the sea valve cover 13 and connected to the sea valve cover 13 by means of a valve rod 12. The hydraulic machine 11 can control the sea valve cover 13 to be opened or closed to control the water level in the ballast compartment 14.

A hydraulic machine compartment 10 is arranged in the ballast compartment 14, located above the sea valve cover 13 and fixed to a bottom wall of the ballast compartment 14, the hydraulic machine 11 is arranged in the hydraulic machine compartment 10, and a second sea valve hole 9 is formed in a side wall between the hydraulic machine compartment 10 and the sea valve cover 13.

Preferably, multiple second sea valve holes 9 are formed in the side wall between the hydraulic machine compartment 10 and the sea valve cover 13 to ensure that ballast water can normally flow into or out of the ballast compartment 14.

By controlling the vent valve cover 8 and the sea valve cover 13 to be opened or closed, the pressure in the ballast compartment 14 can be kept stable. When the vent valve cover 8 and the sea valve cover 13 are opened at the same time, the gas pressure in the ballast compartment 14 can be regulated to control the water level in the flow-guide column base 1 to adjust the draft of the offshore platform 2 and the height of center of gravity and buoyancy of the offshore platform 2, thus effectively controlling the stability of the offshore platform 2.

As shown in FIG. 4, the spiral side belt system comprises multiple guide rails 17, two retainer rings 15 and a retractable spiral side belt 16.

The multiple guide rails 17 are symmetrically arranged on an outer surface of the flow-guide column base 1.

The two retainer rings 15 are disposed around the outer surface of the flow-guide column base 1 and are able to slide upward and downward along the guide rails 17.

Figure 7:
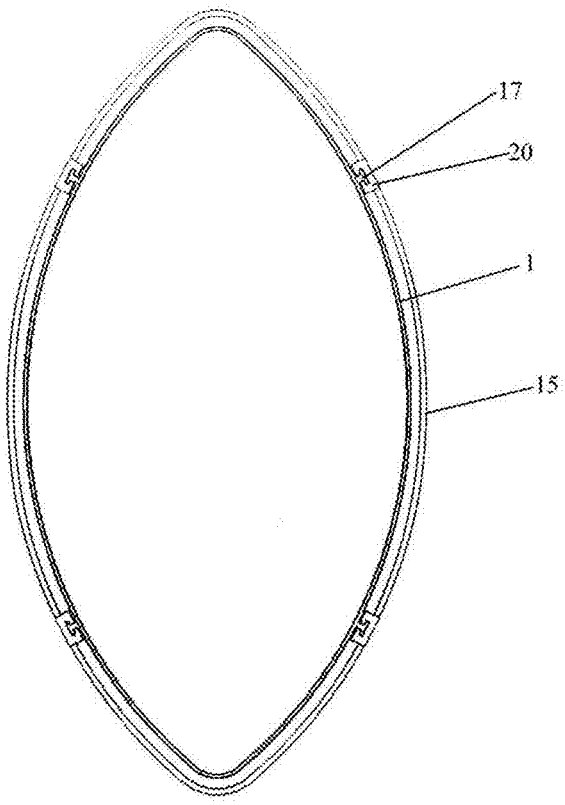
FIG. 7 is a cross-sectional structural view of guide rails according to one embodiment of the invention.

As shown in FIG. 7, the retainer rings 15 are fixed to sliders 20 and slidably connected to the guide rails 17 by means of the sliders 20, such that the retainer rings 15 can slide upward and downward along the guide rails 17.

Electric driving devices (not shown) are mounted on the sliders 20 and used for driving the sliders 20 to slide on the guide rails 17 to drive the retainer rings 15 to move on the guide rails 17.

As shown in FIG. 4, stop pieces 18 are arranged at upper and lower ends of each guide rail 17 and used for limiting upper and lower positions to which the retainer rings 15 move.

As shown in FIG. 4, the spiral side belt 16 spirally covers the outer surface of the flow-guide column base 1 within 360°. Wherein, the spiral side belt 16 is made from a flexible material. The spiral side belt 16 is located between the two retainer rings 15 and has two ends connected to the two retainer rings 15 respectively. The spiral side belt 16 is connected to the guide rails 17 by means of the upper and lower retainer rings 15, and the spiral side belt 16 can be controlled to be retracted or unwound by controlling the retainer rings 15 to slide on the guide rails 17. When the two retainer rings 15 are controlled to move close to each other, the spiral side belt 16 will be retracted under the action of the two retainer rings 15. When the two retainer rings 15 are controlled to move away from each other, the spiral side belt 16 will be unwound under the action of the two retainer rings 15.

When the spiral side belt 16 is in the unwound state, flow characteristics of fluid near the flow-guide column base 1 can be changed to destroy the regularity of a vortex street, thus restraining vortex-induced resonance.

By continuously changing an incoming flow separation angle in a radial direction, the spiral side belt 16 can disturb the spatial correlation length of the vortex street to reduce the intensity of the vertex street so as to reduce a lateral force, thus restraining vortex-induced vibrations.

When the angle of the offshore platform does not need to be adjusted, the flow-guide column base 1 is used for improving the stability of the offshore platform; in this case, the clamping rods 6 are retracted to the bottom of the offshore platform 2 to allow the flow-guide column base 1 to be full of ballast water, and the two retainer rings 15 are controlled to be located on two sides of the guide rails 17 respectively to unwind the spiral side belt 16.

The spiral side belt 16 of the spiral side belt system can be retracted when the flow-guide column base 1 rotates, such that the flow guide effect of the flow-guide column base 1 will not be affected. When the direction of waves does not need to be adjusted by the flow-guide column base 1, the spiral side belt 16 can be unwound to restrain vortex-induced resonance that possibly happens to a deep-draft platform.

For example, in a case where the flow-guide column base 1 and the offshore platform 2 are kept in the relatively fixed state, the operating principle of the flow-guide device for an offshore platform is as follows:

When the direction of a sea current changes, the clamping rods 6 partially slide into the flow-guide column base 1 to ensure that the flow-guide column base 1 and the offshore platform 2 are kept in the relatively fixed state, and the two retainer rings 15 are controlled to move close to each other to retract the spiral side belt 16. Then, under the action of a thrust applied by waves to the flow-guide column base 1, the offshore platform 2 rotates to allow the waves to flow in forward; in this process, the offshore platform 2 may undergo a static unbalance, and at this moment, the static resilience of fluid can be adjusted by means of the ballast level control device to allow the offshore platform 2 to return to the static balance state more rapidly. After the offshore platform 2 is adjusted to adapt to the direction of the seat current, the clamping rods 6 retract to the bottom of the offshore platform 2, the ballast compartment 14 of the flow-guide column base 1 is full of ballast water, and the two retainer rings 15 are controlled to be located on two sides of the guide rails 17 respectively to unwind the spiral side belt 16 to restrain vortex-induced vibrations that possibly happen to a deep-draft platform.

According to the flow-guide device for an offshore platform provided by the invention, the flow-guide column base can rotate separately or drive the offshore platform to rotate synchronously according to the direction of waves to adjust the inflow direction of the waves, such that the hydrodynamic response in case of a complex incoming flow is small, and the center of gravity of the platform can be lowered to restrain vortex-induced vibrations that possibly happen to a deep-draft platform, thus improving the stability of the offshore platform.

The invention is disclosed above with reference to preferred embodiments, but these preferred embodiments are not used to limit the invention. All technical solutions obtained by equivalent substitution or transformation should also fall within the protection scope of the invention.

The invention claimed is:

1. A flow-guide device for an offshore platform, comprising a flow-guide column base (1), a ballast level control device and a spiral side belt system, wherein the flow-guide column base (1) is located at a bottom of an offshore platform (2), and multiple said flow-guide column bases (1) are arranged symmetrically and distributed in a ring array; a cross-section of the flow-guide column base (1) is in a streamlined shape, and the flow-guide column base (1) is rotatably connected to the offshore platform (2); a ballast compartment (14) is arranged in the flow-guide column base (1), and the ballast level control device is used for controlling a ballast level in the ballast compartment (14); and the spiral side belt system is arranged outside the flow-guide column base (1) and used for restraining vortex-induced resonance.

2. The flow-guide device for an offshore platform according to claim 1, wherein a shape of the cross-section of the flow-guide column base (1) satisfies:

$$C_{wp} = \frac{A_w}{LB}$$

$$0.45 < C_{wp} < 0.65$$

where, $C_{wp}$ is a wetted area coefficient, $A_w$ is an area of the cross-section of the flow-guide column base (1), L is a length of a long axis of the cross-section of the flow-guide column base (1), and B is a length of a short axis of the flow-guide column base (1).

3. The flow-guide device for an offshore platform according to claim 1, wherein the flow-guide column base (1) is connected to the offshore platform (2) by means of a rotating device (3), the rotating device (3) comprises a stepped rotating platform arranged at a top of the flow-guide column base (1), a groove (4) matched with the stepped rotating platform is formed in the bottom of the offshore platform (2), and the stepped rotating platform is inlaid in the groove (4), such that the flow-guide column base (1) is rotatable with respect to the offshore platform (2).

4. The flow-guide device for an offshore platform according to claim 1, further comprising a clamping device, wherein the clamping device is used for keeping the flow-guide column base (1) and the offshore platform (2) in a relatively fixed state, such that the offshore platform (2) is able to rotate synchronously with the flow-guide column base (1).

5. The flow-guide device for an offshore platform according to claim 4, wherein the clamping device comprises clamping holes (5) and clamping rods (6), each said clamping hole (5) comprises an upper clamping hole formed in the bottom of the offshore platform (2) and a lower clamping hole formed in a top of the flow-guide column base (1) and corresponding to the upper clamping hole, and the clamping holes (5) are distributed in a ring array; and one said clamping rod (6) is arranged in each said clamping hole (5), and the clamping rods (6) completely retract to the bottom of the offshore platform (2) or partially slide into the flow-guide column base (1) by means of the clamping holes to keep the flow-guide column base (1) and the offshore platform (2) in the relatively fixed state.

6. The flow-guide device for an offshore platform according to claim 1, wherein the ballast level control device comprises a vent valve duct (7), and the vent valve duct (7) is located at a center of a top of the flow-guide column base (1) and extends to the bottom of the offshore platform (2); and the vent valve duct (7) is connected to the ballast compartment (14), and a vent valve cover (8) is arranged at a joint of the ballast compartment (14) and the vent valve duct (7) and used for controlling the vent valve duct (7) to be opened or closed.

7. The flow-guide device for an offshore platform according to claim 6, wherein the ballast level control device further comprises a first sea valve hole (19), the first sea valve hole (19) is located in a center of a bottom of the flow-guide column base (1) and connected to the ballast compartment (14), the first sea valve hole (19) is covered with a sea valve cover (13), and a hydraulic machine (11) is arranged above the sea valve cover (13) and connected to the sea valve cover (13) by means of a valve rod (12).

8. The flow-guide device for an offshore platform according to claim 7, wherein a hydraulic machine compartment (10) is arranged in the ballast compartment (14), located above the sea valve cover (13) and fixed to a bottom wall of the ballast compartment (14), the hydraulic machine (11) is arranged in the hydraulic machine compartment (10), and a second sea valve hole (9) is formed in a side wall between the hydraulic machine compartment (10) and the sea valve cover (13).

9. The flow-guide device for an offshore platform according to claim 1, wherein the spiral side belt system comprises multiple guide rails (17), two retainer rings (15) and a retractable spiral side belt (16), the multiple guide rails (17) are symmetrically arranged on an outer surface of the flow-guide column base (1), the two retainer rings (15) are disposed around the outer surface of the flow-guide column base (1) and are able to slide upward and downward along the guide rails (17), the spiral side belt (16) spirally covers the outer surface of the flow-guide column base (1) and is located between the two retainer rings (15), and two ends of the spiral side belt (16) are connected to the two retainer rings (15) respectively.

10. The flow-guide device for an offshore platform according to claim 9, wherein stop pieces (18) are arranged at upper and lower ends of each said guide rail (17) and used for limiting upper and lower positions to which the retainer rings (15) move.

* * * * *